US007847192B2

(12) United States Patent
Grögl et al.

(10) Patent No.: US 7,847,192 B2
(45) Date of Patent: Dec. 7, 2010

(54) ELECTRICAL CONDUCTOR

(75) Inventors: Ferdinand Grögl, Nuremberg (DE); Thomas Mann, Welssenohe (DE)

(73) Assignee: Nexans, Paris (FR)

( * ) Notice: Subject to any disclaimer, the term of this patent is extended or adjusted under 35 U.S.C. 154(b) by 59 days.

(21) Appl. No.: 12/361,717

(22) Filed: Jan. 29, 2009

(65) Prior Publication Data

US 2009/0211784 A1 Aug. 27, 2009

(30) Foreign Application Priority Data

Feb. 26, 2008 (EP) ..... 08290201

(51) Int. Cl.
*H01B 5/08* (2006.01)

(52) U.S. Cl. ..... 174/128.1

(58) Field of Classification Search ..... 174/128.1, 174/128.2

See application file for complete search history.

(56) References Cited

U.S. PATENT DOCUMENTS 2,138,420 A * 11/1938 Grobl et al. ..... 57/213
3,339,012 A * 8/1967 Hutchins, Jr. ..... 174/128.1
3,676,578 A * 7/1972 Cahill ..... 174/128.1
7,228,627 B1 * 6/2007 Yoshimura et al. ..... 29/872
2003/0037957 A1 2/2003 Ueno et al.

FOREIGN PATENT DOCUMENTS

DE 102004041452 3/2006
DE WO2007015345 2/2007

* cited by examiner

*Primary Examiner*—Chau N Nguyen
(74) *Attorney, Agent, or Firm*—Sofer & Haroun, LLP

(57) ABSTRACT

An electrical conductor L is specified, which has a central core (1) and at least two layers which are arranged above the core (1) and are composed of electrically conductive individual wires, which are twisted around the core (1) in a first layer (2) and around the first layer (2) in a second layer (4). The individual wires of the first layer (2) are steel wires with an ultimate tensile strength of between 800 N/mm$^2$ and 2000 N/mm$^2$, and the individual wires of the second layer (4) are copper wires with an ultimate tensile strength of between 250 N/mm$^2$ and 400 N/mm$^2$. A wire composed of a soft-annealed copper with an ultimate tensile strength of at least 210 N/mm$^2$ is used as the core (1). The lay length of the copper wires (5) is between 8×D and 18×D where D is the diameter of the conductor L over the second layer.

7 Claims, 1 Drawing Sheet

ELECTRICAL CONDUCTOR

RELATED APPLICATION

This application claims priority to European Patent Application No. 08 290 201.6, filed on Feb. 26, 2008, the entirety of which is incorporated by reference.

BACKGROUND

1. Field of the Invention

The invention relates to an electrical conductor.

2. Description of Related Art

A conductor is disclosed in WO 2007/015345 A1.

By way of example, a conductor such as this is used in motor vehicles, for example in wiring or sensor lines. However, in principle, it can be used wherever electric current or data is to be transmitted. For use in motor vehicles, it must be possible to bend the conductor wire, the conductor must be flexible and resistant to tension and, in particular fields of use, it must also be able to withstand combined mechanical loads because lines which are equipped with a conductor such as this in a motor vehicle are continuously subject to oscillation and vibration during use.

The known conductor according to DE 10 2004 041 452 A1 has a non-metallic core in the form of a tension-resistant element. Wires composed of copper and with a circular cross section are twisted closely around the core, resting closely on it, in a first layer and a second layer of wires, which are likewise composed of copper and have a circular cross section, is twisted over the first layer, with the number and diameter of the wires being designed such that, when the wires are located closely adjacent to one another, this results in the conductor having a virtually smooth outer surface as a base layer for insulation to be applied to it. This conductor has been proven in practice.

US 2003/0037957 A1 describes an electrical conductor which comprises seven wires composed of soft copper, which are twisted with one another to form a braid. This conductor is intended to be used for movable parts and, in particular, is intended to have high conductivity. The ultimate tensile strength of the wires is 220 MPa or 220 N/mm$^2$. They can be twisted with one another with a lay length of 15×D, where D is the diameter of the conductor.

The known electrical conductor according to the initially cited WO 2007/015345 A1 has a core composed of seven steel wires, which are twisted with one another, and a layer which surrounds the core and is composed of twelve copper wires. This conductor is intended to have smaller dimensions than known conductors. The steel wires have an ultimate tensile strength of 920 MPa or 920 N/mm$^2$ or more, and the ultimate tensile strength of the copper wires is 220 MPa or 220 N/mm$^2$, or more.

SUMMARY

The object of the invention is to improve the tensile strength and vibration resistance of the conductor described initially, and to design it such that it is suitable for connection of contact elements by crimping.

This conductor complies with all the mechanical requirements, such as those applicable for its use in motor vehicles, in the long term. Even without a tension-resistant core element, the steel wires make it resistant to tension and, furthermore, when high-strength steel wires are used, it is also resistant to bending, torsion and vibration. The capability to bend the conductor wire is ensured on the one hand by the dimensionally stable concentric design of the two layers that are twisted on and on the other hand by their short twisting lay Length. Furthermore, because of its specific configuration, the conductor is highly suitable for the electrically conductive connection of contact elements by crimping.

If, in one preferred embodiment, the first layer of the conductor is composed of high-strength steel wires, these wires can be mechanically formed by means of a preforming process, which is known from steel cable manufacture, of the individual steel wires or using a post-forming process on the twisted-on layer by rolling, such that mechanical stresses are dissipated in the finished conductor, thus ensuring that the conductor is also not twisted, in addition to the capability to be bent well.

BRIEF DESCRIPTION OF THE DRAWINGS

One exemplary embodiment of the subject matter of the invention is illustrated in the drawings, in which.

DETAILED DESCRIPTION

Figure 1:
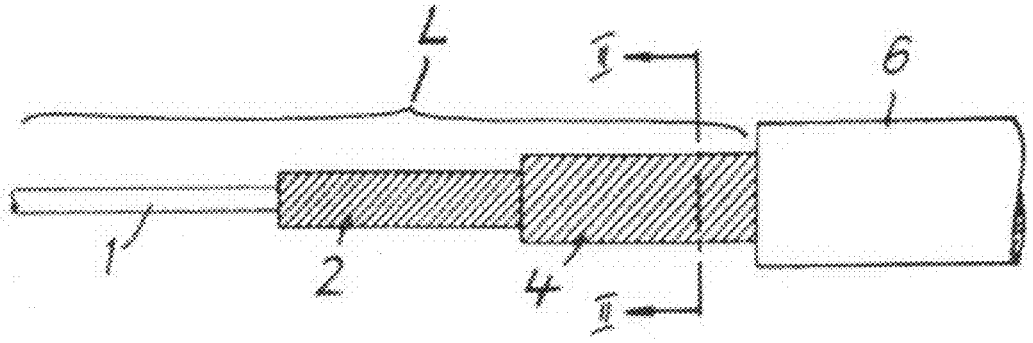
FIG. 1 shows a side view of the conductor according to the invention, with layers removed in places.
Figure 2:
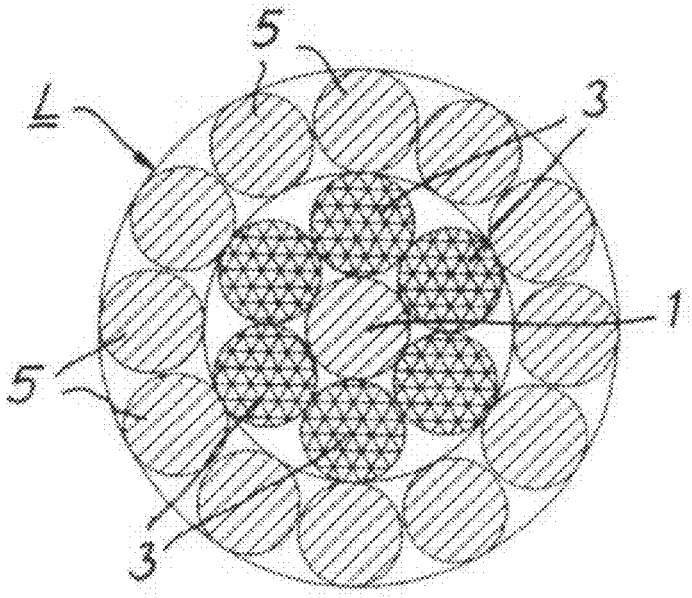
FIG. 2 shows a section through FIG. 1 along the line II-II, illustrated enlarged.

The conductor L has a central core 1 around which steel wires 3 are twisted in a first layer 2. A second layer 4 is arranged above the first layer 2 and is composed of copper wires 5 which are twisted around the steel wires 3. The conductor L can be surrounded by insulation 6 which is produced, for example, by extrusion and/or winding. However, can disc be twisted further with at least two further conductors of identical design, to form a multiple-wire conductor cable.

The core 1 is a wire composed of copper which is soft-annealed during a drawing process, and is preferably free of oxygen. This wire has an ultimate tensile strength of at least 210 N/mm$^2$. The core 1 may be in the form of a bare copper wire, although it may also be tinned, silver-plated or nickel-plated.

The steel wires 3 have an ultimate tensile strength which is between 800 N/mm$^2$ and 2200 N/mm$^2$. It can advantageously be tinned. The steel wires 3 are preferably composed of stainless steel.

The copper wires 5 have an ultimate tensile strength which is between 250 N/mm$^2$ and 400 N/mm$^2$. Like the wire of the core 1, they can likewise be formed from bare wires and/or may be tinned, silver-plated or nickel plated.

Steel wires 3 and copper wires 5 can be twisted onto their respective base with the same lay direction, or else with the opposite lay direction. They can advantageously also be fitted with the same twist angle. The lay length of the copper wires 5 in the second layer is between 8×D and 18×D. In this case, D is the diameter of the conductor L over the second layer 4.

By way of example, the conductor L is produced as follows:

A wire composed of soft-annealed copper is drawn off a spool as a core 1, and is supplied to a twisting unit in which the steel wires 3 of the first layer 2 are twisted around the core 1. In the same process, the copper wires 5 of the second layer 4 can be twisted onto this in a second twisting unit. The finished conductor L can then be wound onto a spool, or can be passed on for further processing.

A twisting process in which the steel wires 3 and the copper wires 5 run off individual spools is carried out, for example, on a tubular laying machine. In this case, the wires are twisted on with a backward rotation of about 90%. The two layers 2 and 4 and therefore also the conductor L are very largely free of mechanical stresses just as a result of preshaping such as this. A twisting process such as this is advantageously used for conductors L which are subject to high mechanical bending, torsion and vibration loads during operation.

In order to further reduce mechanical stresses, once the steel wires 3, which in the preferred embodiment are high-strength steel wires 3, have been twisted on as the first layer 2 the conductor L can then first of all also be passed on to a mechanical post-forming process in which the steel wires 3 are mechanically formed or shaped using a technique which is known from cable manufacture, for example by means of a plurality of pairs of rollers.

In the case of conductors L which are intended to have only an ultimate tensile strength which is considerably higher than that of copper, but which are not subject to any additional mechanical requirements, steel wires 2 can preferably be used with an ultimate tensile strength of between 300 N/mm$^2$ and 1200 N/mm$^2$. Steel wires 3 such as these can be drawn down at the same time and can be wound on jointly in parallel on multiple-wide drawing installations. They may be tinned or, in the case of conductors L which are subject to high thermal loads, may preferably be composed of stainless steel. The raw material for these steel wires may in each case be rods composed of soft steel which is in each case drawn down to form a pre-drawn wire in a rough drawing process, and can then be tinned in an electrochemical process or else in a hot-tinning process. After a fine-drawing process, the tinned steel wires 3 still have a remaining tin layer thickness of at least 0.5 μm. The ultimate tensile strength of the steel wires is increased by the drawing process itself to the desired final value of 800 N/mm$^2$ to 2200 N/mm$^2$.

The twisting process for a conductor L such as this can be carried out in a single process, for example with three tangential run-off spools, by means of a high-speed flyer-type stranding machine using the known double-lay twisting technique. The copper wire 1 is wound up on one of the spools, a second spool has, for example, six steel wires 3 wound on in parallel, and the third spool has, for example, twelve copper wires 5 wound on parallel. A conductor L manufactured in this way can be passed on directly for further processing without any subsequent mechanical processing, that is to say for example, it can be provided with insulation 6.

By way of example, a conductor L can be used in the wiring technology for motor vehicles as a single-core or else a multi-core line in the conductor cross-section range between 0.25 mm$^2$ and 2.5 mm$^2$. The use of six steel wires 3 in a 19-core conductor L admittedly reduces its electrical conductivity in comparison to a copper conductor with the same dimensions, but the ultimate tensile strength of the conductor L can be doubled in comparison to that of the copper conductor with the same cross section. This can advantageously be seen in the case of the conductors which are short in this application, and in which an increased direct-current resistance is insignificant, for example for signal transmission.

The invention claimed is:

1. Electrical conductor comprising:

a central core;

at least two layers, which are arranged above the core composed of electrically conductive individual wires, which are twisted around the core in a first layer and around the first layer in a second layer, in which the individual wires of the first layer are steel wires with an ultimate tensile strength of more than 800 N/mm$^2$, and in which the individual wires of the second layer are copper wires with an ultimate tensile strength of more than 220 N/mm$^2$, wherein a wire composed of a soft-annealed copper with an ultimate tensile strength of at least 210 N/mm$^2$ is used as the core, the ultimate tensile strength of the steel wires is between 800 N/mm$^2$ and 2200 N/mm$^2$, the ultimate tensile strength of the copper wires is between 250 N/mm$^2$ and 400 N/mm$^2$, and the lay length of the copper wires is between 8×D and 18×D where D is the diameter of the conductor over the second layer.

2. Conductor according to claim 1, wherein a bare copper wire is used as the core.

3. Conductor according to claim 1, wherein the core is tinned, silver-plated or nickel-plated.

4. Conductor according to claim 1, wherein the steel wires are tinned or are composed of stainless steel.

5. Conductor according to claim 1, wherein the first layer, which is composed of steel wires, is free of mechanical stresses as a result of mechanical processing.

6. Conductor according to claim 1, wherein copper wires are bare wires.

7. Conductor according to claim 1, wherein the copper wires are tinned, silver-plated or nickel-plated.

* * * * *